US011466891B2

(12) United States Patent
Qin et al.

(10) Patent No.: US 11,466,891 B2
(45) Date of Patent: Oct. 11, 2022

(54) AIR CONDITIONER INDOOR UNIT AND AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Qiang Qin, Foshan (CN); Kuifang Zou, Foshan (CN); Qiankun Liu, Foshan (CN); Xidong Wang, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 342 days.

(21) Appl. No.: 16/676,980

(22) Filed: Nov. 7, 2019

(65) Prior Publication Data

US 2020/0200430 A1 Jun. 25, 2020

Related U.S. Application Data

(63) Continuation of application No. PCT/CN2019/108492, filed on Sep. 27, 2019.

(30) Foreign Application Priority Data

Dec. 25, 2018 (CN) ..... 201822192579.2

(51) Int. Cl.
*F24F 13/06* (2006.01)
*F24F 13/20* (2006.01)
*F24F 1/0035* (2019.01)

(52) U.S. Cl.
CPC ..... *F24F 13/06* (2013.01); *F24F 1/0035* (2019.02); *F24F 13/20* (2013.01)

(58) Field of Classification Search
CPC ..... F24F 1/0007; F24F 1/0035; F24F 1/0057; F24F 1/0059; F24F 1/0068; F24F 13/20; F24F 13/30
(Continued)

(56) References Cited

U.S. PATENT DOCUMENTS

2018/0087783 A1* 3/2018 Ingram ..... F24F 1/56

FOREIGN PATENT DOCUMENTS

CN 203550147 U 4/2014
CN 106678973 A * 5/2017
(Continued)

OTHER PUBLICATIONS

World Intellectual Property Organization (WIPO) International Search Report for PCT/CN2019/108492 dated Sep. 27, 2019 23 Pages(Translation Included).

(Continued)

*Primary Examiner* — Edelmira Bosques
*Assistant Examiner* — Michael James Giordano
(74) *Attorney, Agent, or Firm* — Anova Law Group PLLC

(57) ABSTRACT

An indoor unit includes a housing, an air duct member, and a thermal insulation tube. The housing has an accommodating cavity. the air duct member is detachably mounted in the accommodating cavity. A mounting space is formed at a side of the air duct member in a length direction of the air duct member. The mounting space has a mounting opening facing an outside of the housing. The thermal insulation tube includes a tube section extending along a direction perpendicular to the length direction of the air duct member. The tube section is at least partially arranged in the mounting space.

17 Claims, 3 Drawing Sheets

(58) Field of Classification Search
USPC ..... 454/237
See application file for complete search history.

(56) References Cited

FOREIGN PATENT DOCUMENTS

| | | | | | |
|---|---|---|---|---|---|
| CN | 106678973 | A | | 5/2017 | |
| CN | 206469354 | U | | 9/2017 | |
| CN | 107490073 | A | | 12/2017 | |
| CN | 107796045 | A | * | 3/2018 | |
| CN | 209263169 | U | | 8/2019 | |
| EP | 2604943 | A2 | * | 6/2013 | ..... F24F 1/0007 |
| EP | 2604943 | A2 | | 6/2013 | |
| EP | 2620736 | A2 | | 7/2013 | |
| JP | H10122595 | A | | 5/1998 | |
| JP | 4753708 | B2 | | 8/2011 | |
| JP | 2013124855 | A | | 6/2013 | |
| JP | 2015161493 | A | * | 9/2015 | |
| JP | 2015161493 | A | | 9/2015 | |
| JP | 5888965 | B2 | | 3/2016 | |
| KR | 20020047697 | A | | 6/2002 | |
| KR | 20090050317 | A | * | 5/2009 | |
| WO | 2012111798 | A1 | | 8/2012 | |

OTHER PUBLICATIONS

Japan Patent Office (JPO) Notice of Reasons for Refusal for JP Application No. 2019-561946 dated May 11, 2021 8 Pages (including translation).

World Intellectual Property Organization (WIPO) International Search Report and Written Opinion for PCT/CN2019/108492 with translation dated Dec. 27, 2019 23 Pages.

Intellectual Property Korea (IPK) the Office Action For KR Application No. 10-2019-7033705 dated Oct. 27, 2020 13 Pages (Translation Included ).

The European Patent Office (EPO) Supplementary Search Report for EP Application No. 19794866.4 dated Jul. 23, 2020 1 Page.

The European Patent Office (EPO) Extended Search Report for EP Application No. 19794866.4. dated Jul. 6, 2020 8 Pages.

Japan Patent Office (JPO) the Notice of Reasons for Refusal for JP Application No. 2019-561946 dated Apr. 5, 2022 6 Pages (Translation Included).

* cited by examiner

AIR CONDITIONER INDOOR UNIT AND AIR CONDITIONER

CROSS-REFERENCE TO RELATED APPLICATIONS

This application is a continuation of PCT Application No. PCT/CN2019/108492, filed Sep. 27, 2019, which claims priority to Chinese Patent Application No. 201822192579.2, filed Dec. 25, 2018 with the National Intellectual Property Administration and entitled "Air conditioner indoor unit and air conditioner," the entire contents of both of which are incorporated herein by reference.

FIELD

The present disclosure relates to the field of air conditioner and, more particularly, to an air conditioner indoor unit and an air conditioner.

BACKGROUND

Currently, an air conditioner indoor unit includes an air duct member and a thermal insulation tube, where the thermal insulation tube has a vertical section located in a direction of dismounting and mounting the air duct member. Thus, there easily occur bumps between the thermal insulation tube and the air duct member when dismounting or mounting the air duct member, resulting in an damage to the thermal insulation tube, which causes inconvenience in dismounting and mounting the air duct member, thereby reducing stability and convenience of the indoor unit.

SUMMARY

It is an object of the present disclosure to provide an indoor unit, aiming to improve the stability and convenience of the indoor unit.

In one aspect, the present disclosure provides an indoor unit, including:

a housing having an accommodating cavity, wherein the accommodating cavity includes a mounting space, and a rear side of the mounting space includes a mounting opening facing an outside of the housing;

an air duct member, detachably mounted in the accommodating cavity, wherein the mounting space is arranged at a side in a length direction of the air duct member; and a thermal insulation tube, including a first tube section extending along a height direction of the housing, wherein the first tube section is mounted in the mounting space through the mounting opening.

In an embodiment, the air duct member includes a driving device, and the mounting space is arranged at a side in an axial direction of the driving device.

In an embodiment, the air duct member further includes an impeller, and the impeller is arranged at the other side in the axial direction of the driving device.

In an embodiment, the housing includes a first endplate and a second endplate that are respectively arranged at two ends in a length direction of the air duct member; the first endplate is adjacent to the driving device, the mounting space and the first tube section are arranged between the first endplate and the driving device.

In an embodiment, the accommodating cavity further includes a heat dissipation space arranged at a rear side of the driving device and configured for dissipating heat from the driving device; the first tube section is arranged at a side of the heat dissipation space.

In an embodiment, the indoor unit includes an accommodating box arranged in the mounting space; a rear side of the accommodating box defines a first opening in communication with the mounting opening, and the first tube section is mounted in the accommodating box through the mounting opening and the first opening.

In an embodiment, the accommodating box includes a first side plate, an inner wall surface of the first side plate being facing the mounting opening; and the indoor unit further includes an electrical control box arranged at an outer wall surface of the first side plate.

In an embodiment, the first side plate is provided with at least one heat dissipation hole.

In an embodiment, the accommodating box further includes a second side plate, connected with a side of the first side plate; and the inner wall surface of the first side plate is provided with a connection member, the second side plate is provided with an insertion hole adaptable to the connection member.

In an embodiment, the thermal insulation tube further includes a second tube section extending along an axial direction of the impeller; and the second tube section is arranged at a side in a radial direction of the air duct member, the second tube section is connected with a lower end of the first tube section.

In an embodiment, the indoor unit further includes an accommodating box arranged in the mounting space; and a rear side of the accommodating box is provided with a first opening communicating with the mounting opening, the first tube section is mounted in the accommodating box through the mounting opening and the first opening; and the thermal insulation tube further includes a bent section formed at a junction of the first tube section and the second tube section, and the bent section is arranged outside the accommodating box.

In another aspect, the present disclosure provides an air conditioner, including an air conditioner indoor unit. The air conditioner indoor unit includes: a housing having an accommodating cavity, wherein the accommodating cavity includes a mounting space, and a rear side of the mounting space includes a mounting opening; an air duct member, detachably mounted in the accommodating cavity, wherein the mounting space is arranged at a side in a length direction of the air duct member; a thermal insulation tube, including a first tube section extending along a height direction of the housing, wherein the first tube section is mounted in the mounting space through the mounting opening.

In accordance with the air conditioner indoor unit provided in the present disclosure, the first tube section of the thermal insulation tube extending along the height direction is mounted at a side in the length direction of the air duct member and thus avoids the space on a side in the radial direction of the air duct member, which prevents the thermal insulation tube from being broken or an inconvenience of dismounting the air duct member. In addition, the rear side of the mounting space is provided with a mounting opening, so that the first tube section can be mounted in the mouthing space through the mounting opening, which avoids the interference between the first tube section and other structures during the mounting process, thereby reducing damage to the first tube section, and making the mounting of the first tube section simpler and more convenient.

BRIEF DESCRIPTION OF THE DRAWINGS

In order to illustrate the technical solution in the embodiments of the present disclosure, drawings used in the description of the embodiments of the present disclosure are briefly described below. Obviously, the drawings in the following description are merely some of the embodiments of the present disclosure, and those skilled in the art could obtain other drawings according to the structures shown in the drawings without any creative efforts.

EXPLANATION OF REFERENCE NUMERALS

Figure 1:
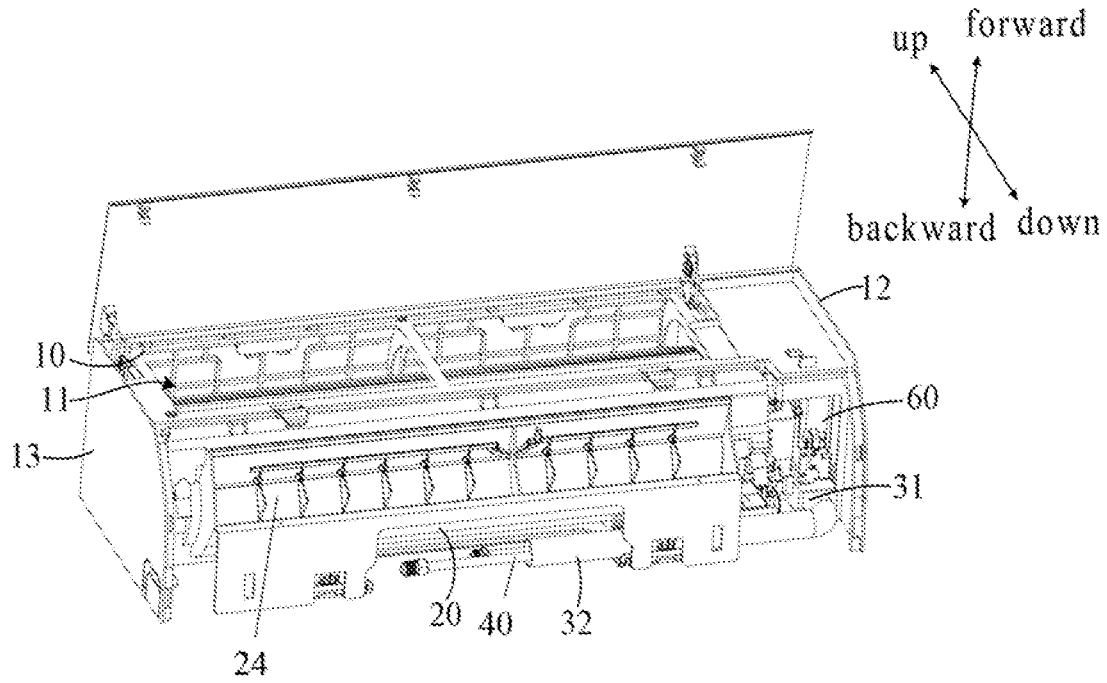
FIG. 1 is a schematic structural view of an air conditioner indoor unit according to an embodiment of the present disclosure.

| Reference numeral | Name |
|---|---|
| 10 | housing |
| 21 | impeller |
| 30 | thermal insulation tube |
| 32 | second tube section |
| 221 | heat dissipation space |
| 60 | electrical control box |
| 512 | connection member |
| 53 | first opening |
| 11 | accommodating cavity |
| 22 | driving device |
| 40 | refrigerant tube |
| 12 | first endplate |
| 50 | accommodating box |
| 511 | heat dissipation hole |
| 521 | insertion hole |
| 20 | air duct member |
| 23 | mounting space |
| 31 | first tube section |
| 13 | second endplate |
| 51 | first side plate |
| 52 | second side plate |
| 33 | bent section |

The realization of the objects, functional characteristics and advantages of the present disclosure are further described in detail with reference to the accompanying drawings.

DETAILED DESCRIPTION OF THE EMBODIMENTS

The technical solutions in the embodiments of the present disclosure will be described in connection with the drawings in the embodiments of the present disclosure. Obviously, the described embodiments are only some of the embodiments of the present disclosure, but not all of them. Based on the embodiments described in the present disclosure, all other embodiments obtained by those skilled in the art without creative work shall belong to the scope of the present disclosure.

It should be understand that, all directional indications (such as "upper," "lower," "left," "right," "front," "rear," etc.) in the embodiments of the present disclosure are only used to explain the relative positional relationship, motion, and the like, between components in a certain attitude. If the particular attitude changes, the directional indication changes accordingly.

In addition, terms such as "first" and "second" are used herein for purposes of description and are not intended to indicate or imply relative importance or to imply the number of indicated technical features. Thus, a feature associated with "first" and "second" may comprise or imply at least one of these features. The meaning of "and/or" appearing throughout the disclosure includes three scenarios. For example, "A and/or B" includes the A scenario, or the B scenario, or the scenario in which both A and B are simultaneously satisfied. Besides, the technical solutions of various embodiments can be combined with each other as long as they do not conflict with each other.

The present disclosure provides an air conditioner indoor unit.

Figure 2:
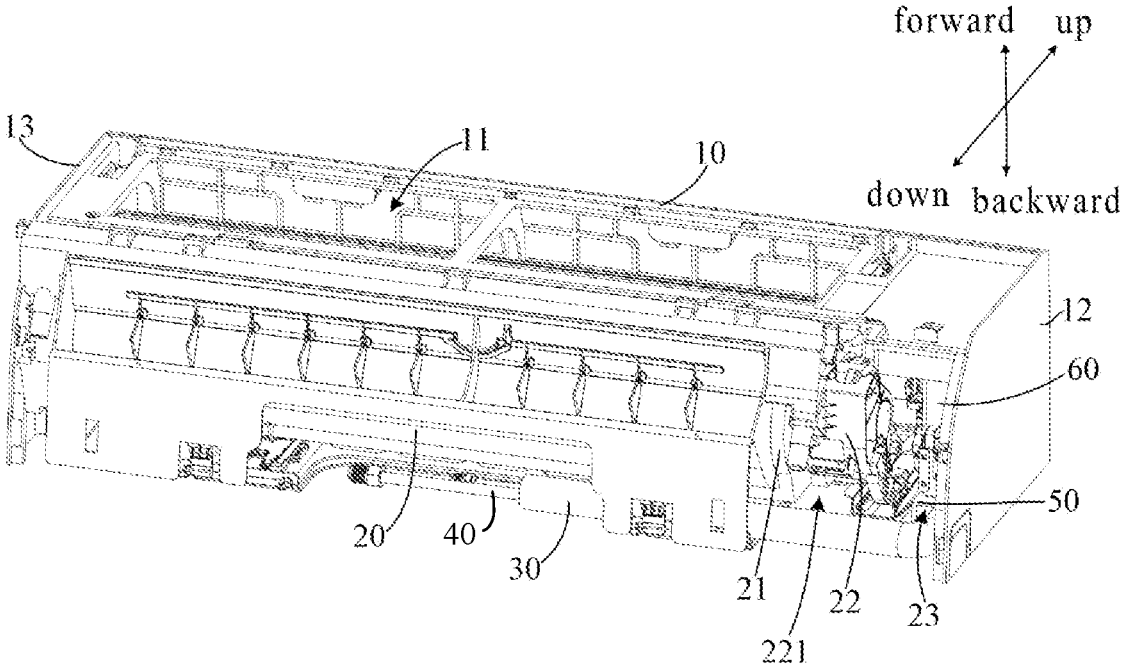
FIG. 2 is a schematic structural view of an air conditioner indoor unit according to another embodiment of the present disclosure.

In an embodiment, as shown in FIGS. 1 and 2, the indoor unit includes:

a housing 10, having an accommodating cavity 11;

an air duct member 20, detachably mounted in the accommodating cavity 11, wherein the air duct member 20 includes an impeller 21 and a driving device 22 arranged at an end in an axial direction of the impeller 21, a side of the driving device 22 away from the impeller 21 is provided with a mounting space 23, and a rear side of the mounting space 23 includes a mounting opening; and a thermal insulation tube 30, at least partially mounted in the accommodating cavity 11, configured to accommodate a refrigerant tube 40, wherein the thermal insulation tube 30 includes a first tube section 31 extending along a height direction of the housing 10, the first tube section 31 can be mounted into the mounting space 23 through the mounting opening.

In this embodiment, it should be noted that the height direction refers to an up- down direction when the indoor unit is mounted at a wall. With respect to the indoor unit mounted at the wall, the side away from the wall is the front side, the side close to the wall is the rear side, and the length direction is the axial direction of the impeller 21. Therefore, when the indoor unit is mounted at the wall, the height direction of the housing 10 is in a vertical plane and perpendicular to the axial direction of the impeller 21, and a front-rear direction of the housing 10 is in a horizontal plane and perpendicular to the axial direction of the impeller 21. The accommodating cavity 11 is configured to accommodate the air duct member 20 and a heat exchanger 70. The air duct member 20 is at least partially mounted in the accommodating cavity 11. The air duct member 20 includes an air outlet frame 24, an impeller 21 and a driving device 22 for driving the impeller 21, where the impeller 21 and the driving device 22 are mounted at the air outlet frame 24. Thus, when the air duct member 20 needs to be dismounted, the air outlet frame 24 can be dismounted, and the impeller 21 and the driving device 22 are dismounted together with the air outlet frame 24. In the mounted state of the indoor unit, the air duct member 20 can exit the accommodating cavity 11 downwards. The impeller 21 is arranged at one end in the axial direction of the driving device 22, and the mounting space 23 is arranged at the other end in the axial direction of the driving device 22. For example, in the mounted state of the indoor unit, the impeller 21 is arranged at the left side of the driving device 22, and the mounting space 23 is arranged at the right side of the driving device 22. The mounting space 23 may be arranged at the exact right side, or the right front side, or the right rear side of the driving device 22, as long as it is not on a side in the radial direction of the driving device 22. The thermal insulation tube 30 is used to accommodate a refrigerant tube 40, so as to protect the refrigerant tube 40 and prevent the refrigerant tube 40 from dripping. One end of the first tube section 31 is adjacent to the heat exchanger 70. The heat exchanger 70 is located above the air duct member 20. The other end of the first tube section 31 extends downwardly to a position adjacent to the bottom of the accommodating cavity 11. As such, the refrigerant tube 40 can extend from an end connected to the heat exchanger 70 to the bottom of the accommodating cavity 11 and further extend to the outside. The mounting space 23 may be arranged at the rear side of the accommodating cavity 11, and the first tube section 31 is accordingly arranged at the rear side of the accommodating cavity 11, which allows other structures to be mounted at the front side of the first tube section 31 for hiding and protecting the first tube section 31. The rear side of the mounting space 23 is provided with a mounting opening, that is, as the indoor unit is in the mounted state, the mounting opening faces the wall surface. It can be understood that the mounting opening is adaptable to the first tube section 31, such that the first tube section 31 can enter the mounting space 23 through the mounting opening from rear to front, which facilitates the mounting of the first tube section 31, and reduces interference between other structures of the indoor unit and the first tube section, thereby preventing the first tube section from being damaged during the installation.

In accordance with the indoor unit provided in present disclosure, the first tube section 31 of the thermal insulation tube 30 extending along the height direction is arranged at the side in the axial direction of the driving device 22, and thus avoids the space on the side in the radial direction of the air duct member 20. By this, the first tube section 31 can be prevented from bumping when the air duct member 20 is taken out along the radial direction, thereby avoiding damage to the thermal insulation tube 30 or inconvenience of dismounting the air duct member 30. In addition, the rear side of the mounting space 23 is defined with the mounting opening facing the outside of the housing 10, which facilitates the installation of the first tube section 31 into the mounting space 23 from the rear side of the housing 10 through the mounting opening, reducing the interference between the first tube section 31 and other structures during the installation process, thereby making the installation of the first tube section 31 simpler and more convenient.

Further, as shown in FIGS. 1 and 2, the housing 10 includes a first endplate 12 and a second endplate 13 that are arranged at two ends in the length direction of the air duct member 20. The first endplate 12 is adjacent to the driving device 22, and the first tube section 31 is located between the first endplate 12 and the driving device 22. In this embodiment, the distance between the first endplate 12 and the second endplate 13 is the length of the accommodating cavity 11. The mounting space 23 is arranged in a space between the driving device 22 and the first endplate 12, and more adjacent to the rear side of the first endplate 12. The first tube section 31 is disposed between the first endplate 12 and the driving device 22, and this allows a reasonable utilization of the accommodating cavity 11, reduces interference between the first tube section 31 and other structures in the accommodating cavity 11, thereby facilitating the protection of the first tube section 31 and improving the stability of the indoor unit.

Further, as shown in FIGS. 1 and 2, the accommodating cavity 11 includes a heat dissipation space 221 disposed at the rear side of the driving device 22, configured for dissipating heat from the driving device, and the first tube section 31 is located on a side of the heat dissipation space 221. In this embodiment, the rear side of the driving device 22 refers to the side that the driving device 22 faces the wall surface when in the mounted state of the indoor unit. The heat dissipation space 221 is arranged at the rear side of the driving device 22, and the first tube section 31 is located on the right side of the heat dissipation space 221. In the prior art, the first tube section 31 is located at the rear side of the driving device 22. Instead, in this embodiment, the first tube section 31 is located at the right rear side of the driving device 22, such that the heat dissipation space 221 on the rear side of the driving device 22 helps to increase the heat dissipation rate of the driving device 22, thereby improving the stability of the driving device 22.

Figure 3:
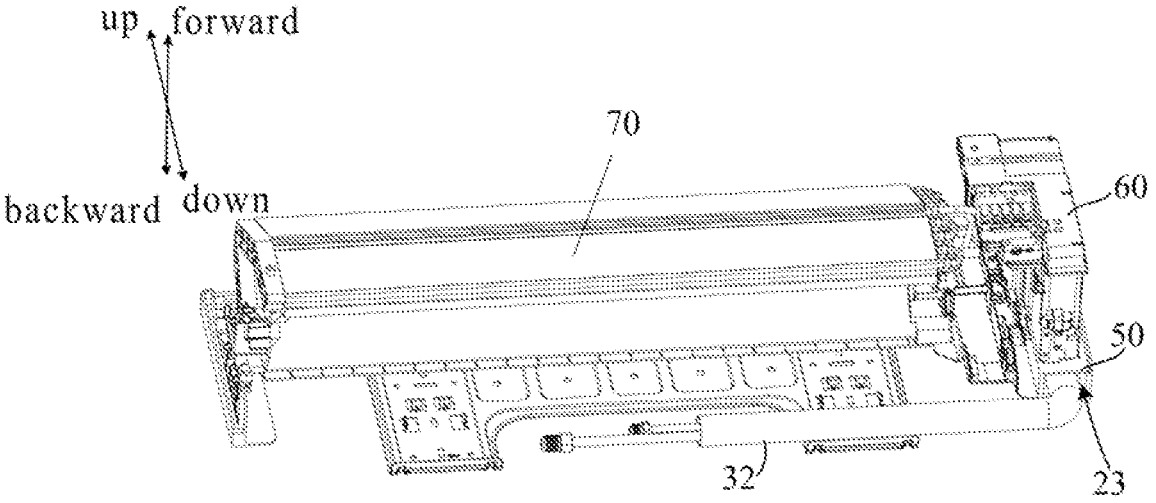
FIG. 3 is a schematic disassembly view of partial structures according to an embodiment of the present disclosure.
Figure 4:
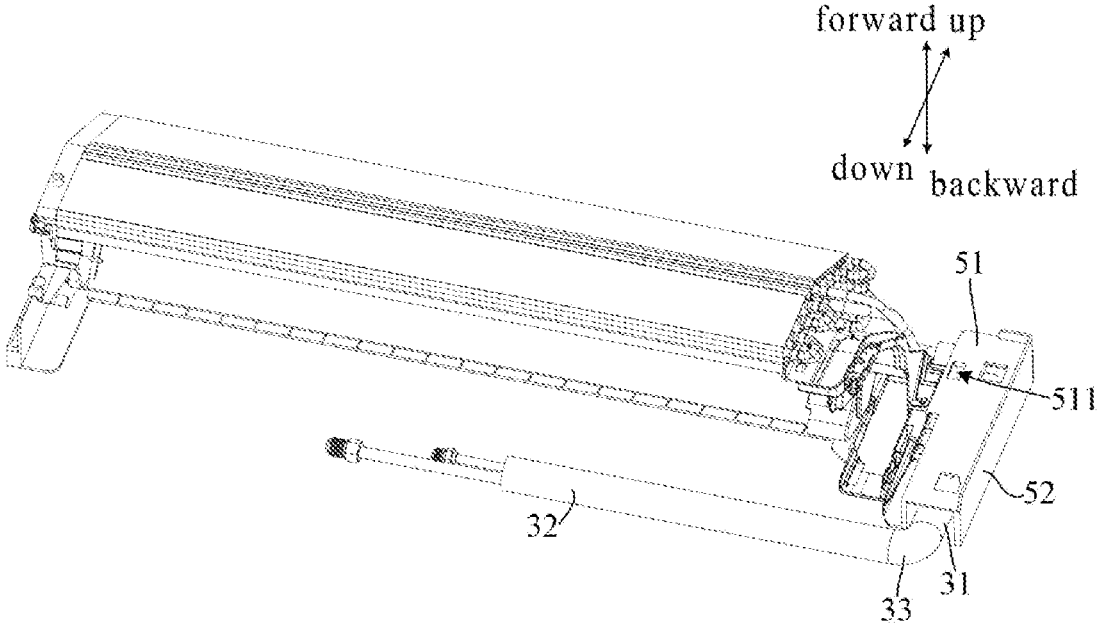
FIG. 4 is a schematic disassembly view of partial structures according to another embodiment of the present disclosure.
Figure 5:
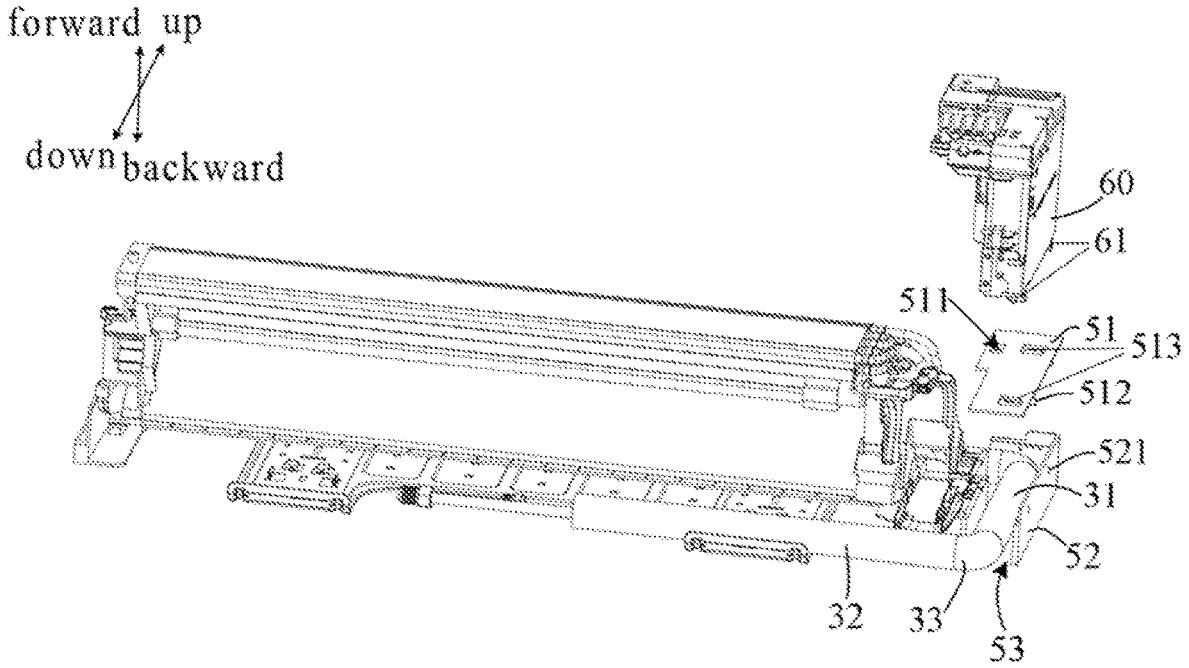
FIG. 5 is a schematic disassembly view of partial structures according to still another embodiment of the present disclosure.

Further, as shown in FIGS. 3 to 5, the indoor unit further includes an accommodating box 50 disposed at the mounting space 23. The rear side of the accommodating box 50 is provided with a first opening 53 communicating with the mounting opening. Thus, the first tube section 31 can be placed in the accommodating box 50 through the mounting opening and the first opening 53. In this embodiment, combined with any of the above embodiments, the accommodating box 50 is disposed between the driving device 22 and the first endplate 12, and the first tube section 31 is mounted in the accommodating box 50. The accommodating box 50 includes at least a left side plate, a right side plate, and a front side plate that covers the front edges of the left and right side plates. The mounting opening is formed in the housing 10, and the accommodating box 50 is disposed at the mounting space 23. The first opening 53 is in communication with the mounting opening, that is, the first opening 53 also faces the wall. It can be understood that the mounting opening is formed on the rear side of the housing 10, and the first opening 53 is formed on the rear side of the accommodating box 50, so that the first tube section 31 can enter the accommodating box 50 through the mounting opening and the first opening 53 at the same time or sequentially. The first tube section 31 is mounted in the accommodating box 50, so that the first tube section 31 can be separated from other structures of the accommodating cavity 11, thereby realizing an effective protection for the thermal insulation tube 30.

Further, as shown in FIGS. 3 to 5, the accommodating box 50 includes a first side plate 51 of which an inner wall surface faces the mounting opening. In addition, the indoor unit includes an electrical control box 60 mounted at an outer wall surface of the first side plate 51. In this embodiment, the outer wall surface of the first side plate 51 faces forward, and the electrical control box 60 is mounted at the first side plate 51 for supplying electric power to electrical structures of the indoor unit. The rear end of the electrical control box 60 is provided with a buckle 61, and the first side plate 51 is provided with a buckle hole 513 for receiving the buckle 61. The cooperation of the buckle 61 and the buckle hole 513 permits a detachable mounting of the electrical control box 60 at the first side plate 51. The electrical control box 60 is mounted at the first side plate 51, that is, mounted at the front sidewall of the accommodating box 50. Usually when the indoor unit is placed on a ground, the back thereof is placed on the ground surface. At this condition, the outer wall surface of the first side plate 51 is facing upward, and accordingly a relative position turns to that the electrical control box 60 is above the accommodating box 50, such that the accommodating box 50 can provide a certain anti-dropping effect for the electrical control box 60 during the landing process, thereby effectively protecting the electrical control box 60.

Further, as shown in FIGS. 3 to 5, the first side plate 51 is provided with a heat dissipation hole 511. In this embodiment, the electrical control box 60 is mounted at the first side plate 51, and the heat dissipation hole 511 is in communication with an inner cavity of the accommodating box 50, so that the accommodating box 50 provides the mounting space 23 for the first tube section 31, and also the heat dissipation cavity for the electrical control box 60, thus ensuring the stability of both the thermal insulation tube 30 and the electrical control box 60.

Further, as shown in FIGS. 3 to 5, the accommodating box 50 further includes a second side plate 52 connected with a side of the first side plate 51. The inner wall surface of the first side plate 51 is provided with a connection member 512, and the second side plate 52 is provided with an insertion hole 521 adaptable to the connection member 512. In this embodiment, the second side plate 52 is disposed adjacent to the first endplate 12, and the second side plate 52 is combined with the first side plate 51 to form the mounting space 23 in the accommodating box 50. The connection member 512 is adjacent to the right side of the first side wall. The cooperation of the connection member 512 and the insertion hole 521 permits a detachable connection between the first side plate 51 and the second side plate 52. As such, during the process of assembling the indoor unit, first the first tube section 31 is placed in the mounting space 23, then the first side plate 51 is placed, and then the electrical control box 60 is mounted at the outer wall surface of the first side plate 51, thereby making the overall assembly simpler and more convenient. In practice, the front side edge of the second side plate 52 is provided with a limiting member that is extended out of the outer wall surface of the first side plate 51, so as to limit the end of the electrical control box 60 adjacent to the first side plate 51 when placing the indoor unit on the ground or on the table, thereby improving the stability of the installation of the electrical control box 60.

Further, as shown in FIGS. 1 to 5, the thermal insulation tube 30 further includes a second tube section 32 extending along the axial direction of the impeller 21. The second tube section 32 is located on a side in the radial direction of the air duct member 20 and connected with a lower end of the first tube section 31. In this embodiment, the second tube section 32 extends along the length direction of the housing 10 and is located at a lower rear of the air duct member 20. It should be noted that the air duct member 20 will not interference with the second tube section 32 when exiting the accommodating cavity 11 along a forward and downward direction. The air outlet frame 24 of the air duct member 20 connected to the housing 10 can support the second tube section 32, which makes the second tube section 32 more stable. The second tube section 32 is in communication with the first tube section 31, for the arrangement of the refrigerant tube 40.

Further, as shown in FIGS. 1 to 5, the thermal insulation tube 30 further includes a bent section 33 formed at a junction between the first tube section 31 and the second tube section 32. In this embodiment, the bent section 33 is located outside the accommodating box 50, e.g., under the first tube section 31. This reduces the volume of the accommodating box 50 and accordingly the occupied space of the accommodating box 50, thereby making the internal structure of the indoor unit simpler and more compact.

The present disclosure also provides an air conditioner, including an air conditioner indoor unit. For the specific structure of the indoor unit, reference can be made to any of the above embodiments. It should be understood that since the air conditioner herein adopts all the technical solutions of the above embodiments, thus can achieve all the technical effects introduced by the above embodiments.

The foregoing description merely portrays some illustrative embodiments in accordance with the disclosure and therefore is not intended to limit the scope of the disclosure. Any equivalent structure transformations that are made taking advantage of the specification and accompanying drawings of the disclosure and any direct or indirect applications thereof in other related technical fields shall all fall in the scope of the disclosure.

What is claimed is:

1. An indoor unit comprising:

a housing having an accommodating cavity;

an air duct member detachably mounted in the accommodating cavity, a mounting space being formed at a side of the air duct member in a length direction of the air duct member, and the mounting space having a mounting opening facing an outside of the housing;

a thermal insulation tube including a tube section extending along a direction perpendicular to the length direction of the air duct member, the tube section being at least partially arranged in the mounting space;

an accommodating box arranged at the mounting space, the tube section being mounted in the accommodating box, a rear side of the accommodating box including an opening in communication with the mounting opening, the accommodating box including a side plate, an inner wall surface of the side plate facing the mounting opening, and the side plate including at least one heat dissipation hole; and an electrical control box arranged at an outer wall surface of the side plate.

2. The indoor unit according to claim 1, wherein:

the air duct member includes a driving device; and the mounting space is arranged at a side of the driving device in an axial direction of the driving device.

3. The indoor unit according to claim 2, wherein:

the side of the driving device is a first side of the driving device; and the air duct member further includes an impeller arranged at a second side of the driving device in the axial direction of the driving device.

4. The indoor unit according to claim 3, wherein:

the first side of the driving device faces the tube section; and the second side of the driving device faces away from the tube section.

5. The indoor unit according to claim 3, wherein:

the air duct member further includes an air outlet frame; and the impeller and the driving device are mounted at the air outlet frame.

6. The indoor unit according to claim 2, wherein:

the accommodating cavity includes a heat dissipation space arranged at a rear side of the driving device and configured to dissipate heat from the driving device; and the tube section is arranged at a side of the heat dissipation space.

7. The indoor unit according to claim 1, wherein the mounting space is formed close to a rear side of the accommodating cavity.

8. The indoor unit according to claim 1, further comprising:

a heat exchanger arranged above the air duct member;

wherein one end of the tube section is adjacent to the heat exchanger, and another end of the tube section is adjacent to a bottom of the accommodating cavity.

9. The indoor unit according to claim 1, wherein the housing includes:

a first endplate and a second endplate arranged close to two ends of the air duct member, respectively, in the length direction of the air duct member, the first endplate being adjacent to the driving device; and the mounting space and the tube section are arranged between the first endplate and the driving device.

10. The indoor unit according to claim 1, wherein:

the electrical control box includes a buckle at a rear end of the electrical control box; and the side plate includes a buckle hole configured to receive the buckle.

11. The indoor unit according to claim 1, wherein:

the side plate is a first side plate including a connection member at the inner wall surface of the first side plate;

the accommodating box further includes a second side plate including an insertion hole; and the second side plate is connected to a side edge of the first side plate via cooperation of the insertion hole and the connection member.

12. The indoor unit according to claim 1, wherein:

the tube section is a first tube section; and the thermal insulation tube further includes a second tube section connected with the first tube section, the second tube section extending along the length direction of the air duct member and being arranged at a side of the air duct member in a radial direction of the air duct member.

13. The indoor unit according to claim 12, wherein the second tube section is arranged at a rear lower side of the air duct member.

14. The indoor unit according to claim 12, wherein:

the thermal insulation tube further includes a bent section arranged outside the accommodating box and formed at a junction between the first tube section and the second tube section.

15. An air conditioner comprising:

an outdoor unit; and an indoor unit connected to the outdoor unit, the indoor unit including:

a housing having an accommodating cavity;

an air duct member detachably mounted in the accommodating cavity, a mounting space being formed at a side of the air duct member in a length direction of the air duct member, and the mounting space having a mounting opening facing an outside of the housing;

a thermal insulation tube including a tube section extending along a direction perpendicular to the length direction of the air duct member, the tube section being at least partially arranged in the mounting space;

an accommodating box arranged at the mounting space, the tube section being mounted in the accommodating box, a rear side of the accommodating box including an opening in communication with the mounting opening, the accommodating box including a side plate, an inner wall surface of the side plate facing the mounting opening, and the side plate including at least one heat dissipation hole; and an electrical control box arranged at an outer wall surface of the side plate.

16. The air conditioner according to claim 15, wherein:

the tube section is a first tube section; and the thermal insulation tube further includes:

a second tube section connected with the first tube section, the second tube section extending along the length direction of the air duct member and being arranged at a side of the air duct member in a radial direction of the air duct member; and a bent section, formed at a junction between the first tube section and the second tube section.

17. An indoor unit comprising:

a housing having an accommodating cavity;

an air duct member detachably mounted in the accommodating cavity, a mounting space being formed at a side of the air duct member in a length direction of the air duct member, the length direction being perpendicular to a forward-backward direction of the air duct member and perpendicular to an up-down direction of the air duct member, and the mounting space having a mounting opening facing backwards to an outside of the housing;

a thermal insulation tube including a tube section extending along a direction perpendicular to the length direction of the air duct member, the tube section being at least partially arranged in the mounting space;

an accommodating box arranged at the mounting space, the tube section being mounted in the accommodating box, a rear side of the accommodating box including an opening in communication with the mounting opening, the accommodating box including a side plate, an inner wall surface of the side plate facing the mounting opening, and the side plate including at least one heat dissipation hole; and an electrical control box arranged at an outer wall surface of the side plate.

* * * * *